US012420376B2

(12) United States Patent
Hsu et al.

(10) Patent No.: US 12,420,376 B2
(45) Date of Patent: Sep. 23, 2025

(54) POLISHING HEAD ASSEMBLY HAVING RECESS AND CAP

(71) Applicant: GlobalWafers Co., Ltd., Hsinchu (TW)

(72) Inventors: Chih Yuan Hsu, Hsinchu (TW); Jen Chieh Lin, Hsinchu (TW); Chieh Hu, Chiayi (TW); Wei Chang Huang, Hsinchu County (TW); Yau-Ching Yang, Zhubei (TW)

(73) Assignee: GlobalWafers Co., Ltd., Hsinchu (TW)

( * ) Notice: Subject to any disclaimer, the term of this patent is extended or adjusted under 35 U.S.C. 154(b) by 366 days.

(21) Appl. No.: 18/065,855

(22) Filed: Dec. 14, 2022

(65) Prior Publication Data

US 2023/0201994 A1 Jun. 29, 2023

Related U.S. Application Data

(60) Provisional application No. 63/265,951, filed on Dec. 23, 2021.

(51) Int. Cl.
*B24B 37/26* (2012.01)

(52) U.S. Cl.
CPC ..... *B24B 37/26* (2013.01)

(58) Field of Classification Search
CPC ..... B24B 37/30; B24B 37/32; B24B 37/10; B24B 37/102; B24B 37/105; B24B 41/047; B24B 41/053
USPC ..... 451/41, 288, 398, 285, 286
See application file for complete search history.

(56) References Cited

U.S. PATENT DOCUMENTS

| | | | |
|---|---|---|---|
| 5,664,989 | A | 9/1997 | Nakata et al. |
| 5,851,136 | A | 12/1998 | Lee |
| 5,964,653 | A | 10/1999 | Perlov et al. |
| 6,056,632 | A | 5/2000 | Mitchel et al. |
| 6,116,992 | A | 9/2000 | Prince |
| 6,162,116 | A | 12/2000 | Zuniga et al. |
| 6,165,056 | A | 12/2000 | Hayashi et al. |
| 6,273,803 | B1 | 8/2001 | Wang et al. |
| 6,623,343 | B2 | 9/2003 | Kajiwara et al. |

(Continued)

FOREIGN PATENT DOCUMENTS

| | | | |
|---|---|---|---|
| CN | 107511721 | A | 12/2017 |
| CN | 111251177 | A | 6/2020 |

(Continued)

OTHER PUBLICATIONS

Extended European Search Report issued for Application No. 22216026.9, on May 11, 2023 (9 pages).

*Primary Examiner* — Robert F Neibaur
(74) *Attorney, Agent, or Firm* — Armstrong Teasdale LLP

(57) ABSTRACT

A polishing head assembly for polishing of semiconductor wafers includes a polishing head and a cap. The polishing head has a recess along a bottom portion. The recess has a recessed surface. The cap is positioned within the recess. The cap includes an annular wall secured to the polishing head and a floor joined to the annular wall at a joint. The floor extends across the annular wall, and the floor has an upper surface and a lower surface. The upper surface is spaced from the recessed surface to form a chamber therebetween. A deformation resistance of a portion of the floor proximate the joint is weakened to allow the portion of the floor proximate the joint to deflect relative to the polishing head by a change of pressure in the chamber.

19 Claims, 8 Drawing Sheets

(56) References Cited

U.S. PATENT DOCUMENTS

| | | | | |
|---|---|---|---|---|
| 6,722,965 | B2 | 4/2004 | Zuniga et al. | |
| 6,746,313 | B1 | 6/2004 | Pham et al. | |
| 6,755,723 | B1 | 6/2004 | Pham | |
| 6,893,327 | B2 | 5/2005 | Kajiwara et al. | |
| 8,088,299 | B2 | 1/2012 | Chen et al. | |
| 8,092,281 | B2 | 1/2012 | Masumara et al. | |
| 9,566,687 | B2 * | 2/2017 | Albrecht | B24B 37/30 |
| 10,857,649 | B2 | 12/2020 | Lee et al. | |
| 2003/0124963 | A1 | 7/2003 | Zuniga et al. | |
| 2006/0160474 | A1 | 7/2006 | Tseng et al. | |
| 2007/0207709 | A1 | 9/2007 | Berkstresser et al. | |
| 2008/0188167 | A1 | 8/2008 | Ishii et al. | |
| 2010/0210192 | A1 | 8/2010 | Masumara et al. | |
| 2014/0357161 | A1 * | 12/2014 | Bhagavat | B24B 37/30<br>451/41 |
| 2018/0304436 | A1 * | 10/2018 | Corsi | B24B 49/14 |

FOREIGN PATENT DOCUMENTS

| | | | |
|---|---|---|---|
| EP | 1092504 | A1 | 4/2001 |
| JP | 2000202762 | A | 7/2000 |
| JP | 6491812 | B2 | 3/2019 |
| JP | 6657201 | B2 | 3/2020 |
| WO | 2016063457 | A1 | 4/2016 |
| WO | 2019208042 | A1 | 10/2019 |
| WO | 2019220712 | A1 | 11/2019 |

* cited by examiner

POLISHING HEAD ASSEMBLY HAVING RECESS AND CAP

CROSS-REFERENCE TO RELATED APPLICATIONS

This application claims priority to U.S. Provisional Patent Application No. 63/265,951, filed Dec. 23, 2021, the disclosure of which is hereby incorporated by reference in its entirety.

FIELD

This disclosure relates generally to polishing of semiconductor wafers and more particularly to a polishing head assembly having a recess and cap.

BACKGROUND

Semiconductor wafers are commonly used in the production of integrated circuit (IC) chips on which circuitry are printed. The circuitry is first printed in miniaturized form onto surfaces of the wafers. The wafers are then broken into circuit chips. This miniaturized circuitry requires that front and back surfaces of each wafer be extremely flat and parallel to ensure that the circuitry can be properly printed over the entire surface of the wafer. To accomplish this, grinding and polishing processes are commonly used to improve flatness and parallelism of the front and back surfaces of the wafer after the wafer is cut from an ingot. A particularly good finish is required when polishing the wafer in preparation for printing the miniaturized circuits on the wafer by an electron beam-lithographic or photolithographic process (hereinafter "lithography"). The wafer surface on which the miniaturized circuits are to be printed must be flat.

Polishing machines typically include a circular or annular polishing pad mounted on a turntable or platen for driven rotation about a vertical axis passing through the center of the pad and a mechanism for holding the wafer and forcing it into the polishing pad. The wafer is typically mounted to the polishing head using for example, liquid surface tension or vacuum/suction. A polishing slurry, typically including chemical polishing agents and abrasive particles, is applied to the pad for greater polishing interaction between the polishing pad and the surface of the wafer. This type of polishing operation is typically referred to as chemical-mechanical polishing (CMP).

During operation, the pad is rotated and the wafer is brought into contact with and forced against the pad by the polishing head. During operation, the pad is rotated and the wafer is brought into contact with and forced against the pad by the polishing head. As the pad wears, e.g., after a few hundred wafers, wafer flatness parameters degrade because the pad is no longer flat, but instead has a worn annular band forming a depression along the polishing surface of the pad. Such pad wear impacts wafer flatness, and may cause "dishing" or "doming" or a combination thereof resulting in a "w-shape".

When the flatness of the wafers becomes unacceptable, the worn polishing pad is replaced with a new one. Frequent pad replacement adds significant costs to the operation of the polishing apparatus not only because of the number of pads that need to be purchased, stored, and disposed of, but also because of the substantial amount of down time required to change the polishing pad.

Accordingly, there is a need for a polishing apparatus that has the ability to optimize flatness parameters by modulating the wafer thickness shape in the polishing process for doming, dishing, and +/−w-shape.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a polishing head assembly for polishing of semiconductor wafers includes a polishing head and a cap. The polishing head has a recess along a bottom portion. The recess has a recessed surface. The cap is positioned within the recess. The cap includes an annular wall secured to the polishing head and a floor joined to the annular wall at a joint. The floor extends across the annular wall, and the floor has an upper surface and a lower surface. The upper surface is spaced from the recessed surface to form a chamber therebetween. A deformation resistance of a portion of the floor proximate the joint is weakened to allow the portion of the floor proximate the joint to deflect relative to the polishing head by a change of pressure in the chamber.

In another aspect, a polishing head assembly for polishing of semiconductor wafers includes a polishing head and a cap. The polishing head has a top portion and a recess along a bottom portion. The recess has a recessed surface. Holes extend from the top portion through the recessed surface. The cap is positioned within the recess. The cap includes an annular wall having apertures corresponding to the holes. The holes and corresponding apertures receive fasteners to secure the annular wall to the recessed surface. The cap also includes a floor joined to the annular wall at a joint. The floor extends across the annular wall. The floor has an upper surface and a lower surface. The upper surface is spaced from the recessed surface to form a chamber therebetween. The floor is capable of deflecting relative to the polishing head by a change of pressure in the chamber. A deformation resistance of a portion of the floor proximate the joint is weakened to allow the portion of the floor proximate the joint to deflect relative to the polishing head.

In another aspect, a polishing head assembly for polishing of semiconductor wafers includes a polishing head and a cap. The cap has an annular wall secured to the polishing head and a floor joined to the annular wall at a joint. The polishing head and the cap define a chamber between the polishing head and the floor of the cap. The floor is made from a metallic material capable of deflecting relative to the polishing head in response to a change of pressure in the chamber. A thickness of at least one of the annular wall and the floor is reduced proximate the joint to weaken a deformation resistance of the floor proximate the joint.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

DETAILED DESCRIPTION

Figure 1:
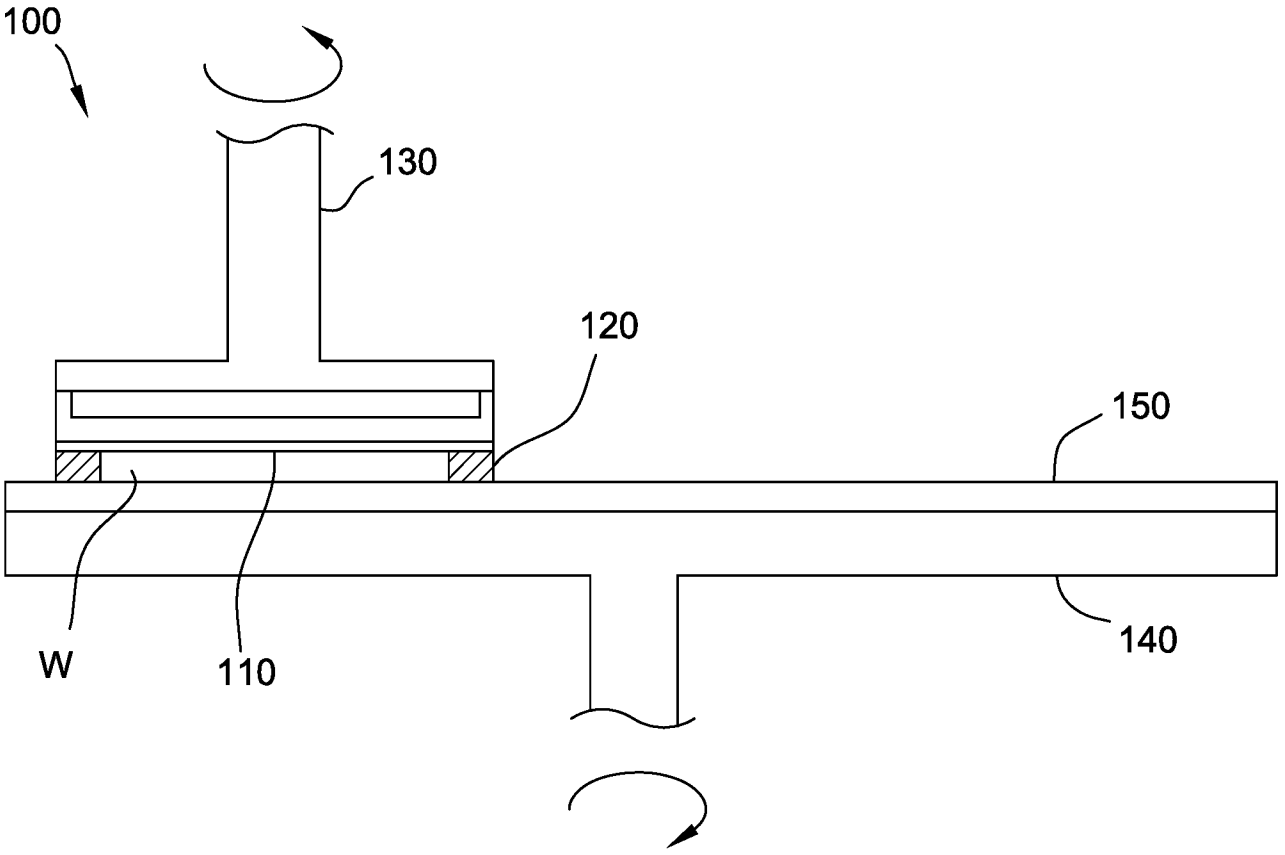
FIG. 1 is a partially schematic elevation of a polishing apparatus.

Generally, and in embodiments of the present disclosure, suitable substrate "wafers" (which may also be referred to as "semiconductor wafers" or "silicon wafers") include single crystal silicon wafers, such as, for example, silicon wafers obtained by slicing the wafers from single crystal silicon ingots formed by the Czochralski method or the float zone method. Each wafer includes a central axis, a front surface, and a back surface parallel to the front surface. The front and back surfaces are generally perpendicular to the central axis. A circumferential edge joins the front and back surfaces. The wafers may be any diameter suitable for use by those of skill in the art including, for example, 200 millimeter (mm), 300 mm, greater than 300 mm or even 450 mm diameter wafers.

In one embodiment, a semiconductor wafer that has previously been rough polished so that it has rough front and back surfaces is first subjected to an intermediate polishing operation in which the front surface of the wafer, but not the back surface, is polished to improve flatness parameters or to smooth the front surface and remove handling scratches. To carry out this operation, the wafer is placed against a polishing head assembly. In this embodiment, the wafer is retained in position against the polishing head assembly by surface tension. The wafer also is placed on a turntable of a polishing machine with the front surface of the wafer contacting the polishing surface of a polishing pad.

A polishing head assembly mounted on the machine is capable of vertical movement along an axis extending through the wafer. While the turntable rotates, the polishing head assembly is moved against the wafer to urge the wafer toward the turntable, thereby pressing the front surface of the wafer into polishing engagement with the polishing surface of the polishing pad.

A conventional polishing slurry containing abrasive particles and a chemical etchant is applied to the polishing pad. The polishing pad works the slurry against the surface of the wafer to remove material from the front surface of the wafer, resulting in a surface of improved smoothness. As an example, the intermediate polishing operation preferably removes less than about 1 micron of material from the front side of the wafer.

The wafer is then subjected to a finish polishing operation in which the front surface of the wafer is finish polished to remove fine or "micro" scratches caused by large size colloidal silica, such as Syton® from DuPont Air Products Nanomaterials, LLC, in the intermediate step and to produce a highly reflective, damage-free front surface of the wafer. The intermediate polishing operation generally removes more of the wafer than the finishing polishing operation. The wafer may be finish polished in the same polishing machine used to intermediate polish the wafer as described above. However, a separate polishing machine may also be used for the finish polishing operation. A finish polishing slurry typically has an ammonia base and a reduced concentration of colloidal silica is injected between the polishing pad and the wafer. The polishing pad works the finish polishing slurry against the front surface of the wafer to remove any remaining scratches and haze so that the front surface of the wafer is generally highly-reflective and damage free.

Referring to FIG. 1, a portion of a polishing apparatus is shown schematically and indicated generally at 100. The polishing apparatus 100 may be used to polish a front surface of semiconductor wafers W. It is contemplated that other types of polishing apparatus may be used.

The polishing apparatus 100 includes a wafer holding mechanism, e.g., a template comprising a backing film 110 and a retaining ring 120, a polishing head assembly 130, and a turntable 140 having a polishing pad 150. The backing film 110 is located between a polishing head assembly 130 and the retaining ring 120, which receives a wafer W. The retaining ring 120 has at least one circular opening to receive the wafer W to be polished therein.

The wafer W in this embodiment is attached to and retained against the polishing head assembly 130 by surface tension. To form the surface tension, the wet saturated backing film 110 is attached to the polishing head assembly 130 with a pressure sensitive adhesive. The backing film 110 and retaining ring 120 form a template or "wafer holding template." The backing film 110 is generally a soft polymer pad or other suitable material.

The wafer W is then pressed into the wet saturated backing film 110 to remove or squeeze out the majority of the water or other suitable liquid. Squeezing out the water causes the wafer to be retained on the backing film 110 by surface tension and the atmospheric pressure on the exposed surface of the wafer. This squeezing out of the water mounts the wafer to the polishing head assembly 130.

A portion of the polishing head assembly 130 is flexible enough to deform in response to a change in pressure applied to the polishing head assembly 130, and stiff enough not to deform when the wafer is pressed into the wet saturated template. The surface tension provides a constant retaining force over the surface of the wafer. This constant retaining force causes any deformation of the polishing head assembly 130 adjacent to the wafer to be directly translated into proportional deformation of the wafer.

The retention of the wafer W by surface tension functions differently than other known mechanisms that use flexible membranes or vacuums to retain the wafer against the polishing head assemblies. Flexible membranes, as known in the art, deform to create space or vacuum pockets between the wafer and the flexible membrane when the wafer is pushed thereon. These vacuum pockets allow the membrane to pick up the wafer. Other membranes have vacuum holes, which are connected to a vacuum to create low pressure areas to pick up wafers.

The polishing apparatus 100 applies a force to the polishing head assembly 130 to move the polishing head assembly 130 vertically to raise and lower the polishing head assembly 130 with respect to the wafer W and the turntable 140. An upward force raises the polishing head assembly 130, and a downward force lowers the polishing head assembly. As discussed above, the downward vertical movement of the polishing head assembly 130 against the wafer W provides the polishing pressure to the wafer to urge the wafer into the polishing pad 150 of the turntable 140. As the polishing apparatus 100 increases the downward force, the polishing head assembly 130 moves vertically lower to increase the polishing pressure.

A portion of the polishing head assembly 130 and polishing pad 150 and turntable 140 are rotated at selected rotation speeds by a suitable drive mechanism (not shown) as is known in the art. The rotational speeds of the polishing pad and the turntable may be the same or different. In some embodiments, the polishing apparatus 100 includes a controller (not shown) that allows the operator to select rotation speeds for both the polishing head assembly 130 and the turntable 140, and the downward force applied to the polishing head assembly.

Figure 2:
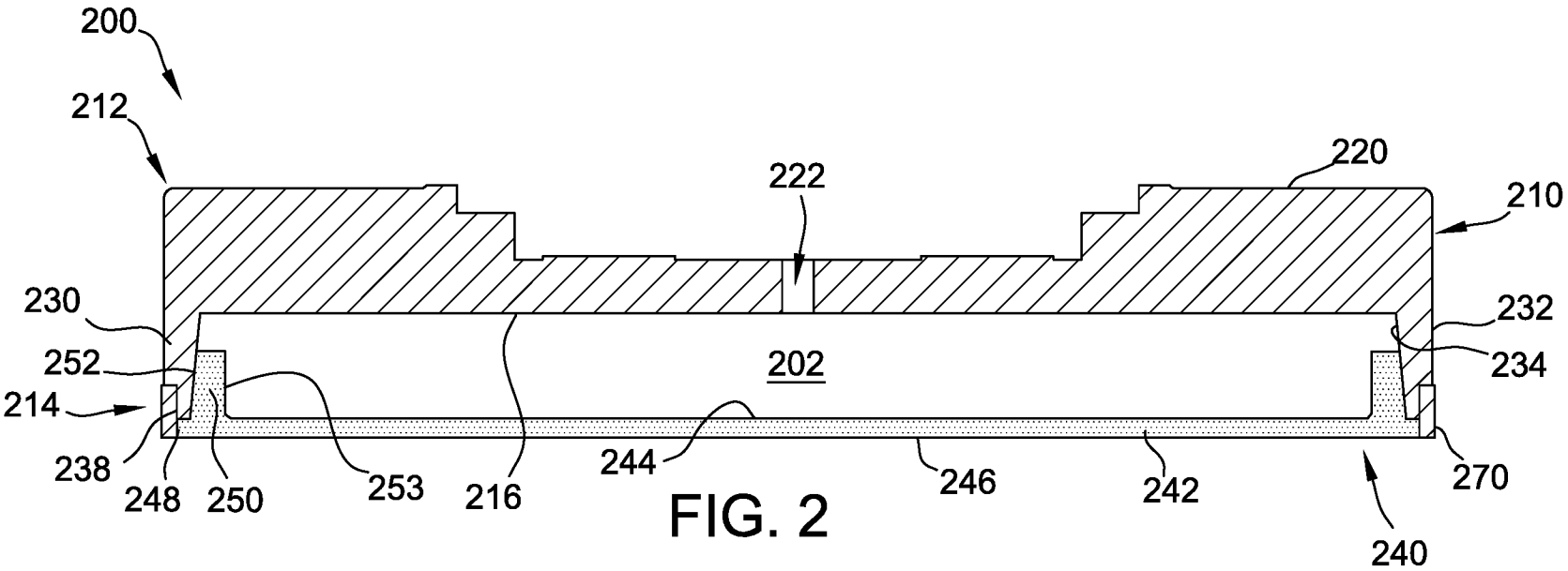
FIG. 2 is a section view of a polishing head assembly adapted for mounting and use in the polishing apparatus shown in FIG. 1.

With reference to FIG. 2, a polishing head assembly 200 adapted for mounting and use in the polishing apparatus 100 is shown. The polishing head assembly 200 includes a polishing head 210, a cap 240, and a band 270. The polishing head 210 and/or cap 240 are suitably made of a metallic material, such as aluminum or steel, or may be made of another suitable structural material. For example, the polishing head 210 and/or cap 240 may be made of cast aluminum (for example, MIC6® Aluminum Cast Plate available from Alcoa.) Alternatively, the cap 240 may be made of a ceramic material, such as alumina, a plastic material, or a stainless steel material with anti-corrosion coating, such as, for example, diamond-like carbon.

The polishing head 210 has a top 212 and a bottom 214 that are substantially parallel with each other. The polishing head 210 has a platform 220 and an annular member 230 extending downwardly from the platform 220. A recessed surface 216 is formed in the bottom 214 of the polishing head 210 by the annular member 230 extending downwardly from the platform 220. The annular member 230 has an outside surface 232 that is substantially perpendicular to the top 212 and bottom 214 of the polishing head 210. The outside surface 232 of the annular member 230 forms the circumference of both the polishing head 210 and the polishing head assembly 200. The annular member 230 has an inside surface 234 that is angled with respect to the outside surface 232 such that the annular member 230 is thinnest at bottom 214 of polishing head 210. This tapering of the annular member 230 provides a stiffer top section adjacent the platform 220. In other embodiments, the inside surface 234 may be substantially parallel to the outside surface 232.

The cap 240 has a floor 242 and an upwardly extending annular wall 250 along the perimeter of the floor. The annular wall 250 has an outer surface 252 that mates with the inside surface 234 of the annular member 230. As such, the outer surface 252 of the annular wall 250 is also angled to match the inside surface 234 of the annular member 230. The outer surface 252 of the annular wall 250 is attached to the inside surface 234 of the annular member 230 of the polishing head 210 with an adhesive (not shown). The adhesive may be an epoxy glue.

The floor 242 extends across a bottom opening formed by the annular member 230. The floor 242 has a top surface 244 and a bottom surface 246. A chamber 202 is formed between the top surface 244 of the floor 242 and the recessed surface 216 of the polishing head 210. The annular member 230 and the annular wall 250 determine the radial boundaries of the chamber 202. The platform 220 and the overlapping annular member 230 and annular wall 250 are thicker and are adapted to be more rigid than the floor 242.

Metal used in the polishing head assembly 200 has the potential to contaminate the wafer by being a source of metal ions through the polishing chemicals or slurry. To prevent the metal from cap 240 from contaminating the slurry and the wafer, a template including a backing film (e.g., backing film 110 shown in FIG. 1) and retaining ring (e.g., retaining ring 120 shown in FIG. 1) may be used to create a barrier between the slurry and the cap 240. The backing film 110 is generally a thin soft polymer pad or other suitable material. Backing film 110 suitably includes two or more layers of material (not shown). For example, backing film 110 may have an adhesive layer, a thin plastic film layer, and a thin polyurethane foam, or other non-woven material (e.g., felt), layer. The adhesive layer seals backing film 110 to bottom surface 246 of cap 240. The thin plastic film layer provides a protective barrier between cap 240 and the slurry and/or wafer W. The layer comprising polyurethane foam or non-woven material (e.g., felt) contacts the wafer and provides a surface similar to that a polishing pad (such as polishing pad 150 shown in FIG. 1). The retaining ring 120 extends downwardly from backing film 110 and is generally a plastic material. The wafer is received by retaining ring 120 and is retained against backing film 110 by surface tension. As such, the wafer does not directly contact the cap 240.

To prevent metal from the polishing head assembly 200 from contaminating the slurry and the wafer, the polishing head 210 and cap 240 are circumscribed with band 270 forming a barrier to prevent the slurry from contacting the metal and contaminating the wafer. The annular member 230 has a side recess 238 that extends inwardly from the outside surface 232 at bottom 214. A tab 248 extends outwardly from the annular wall 250 of cap 240 opposite floor 242. Tab 248 and side recess 238 each receive band 270 and may be sealed thereto with an adhesive, such as epoxy glue. The band 270 may overlap backing film 110 and/or retaining ring 120 of template to form a seal therebetween to prevent metal contamination of the polishing process from the polishing head 210. The band 270 is made of plastic, such as polyetherimide (for example, ULTEM™ Resin 1000 available from Saudi Basic Industries Corporation (SABIC)), polyether ether ketone, polyphenylene sulfide, or polyethylene terephthalate.

The polishing head assembly 200 is attached to a spindle (not shown) of the polishing apparatus 100. The spindle is a tube with a center passage (not shown). The center passage opens to the polishing head assembly 200 at one end and is connected with a rotary connector (not shown) at the other end. To adjust the pressure within the chamber 202, a pressurizing source (not shown) is provided through the center passage and connects to a chamber passageway 222 (e.g., via a quick disconnect coupling plug). The chamber passageway 222 extends through the platform 220 to chamber 202. The pressurizing source (not shown) supplies a pressurized media or fluid to and from the chamber 202 through the spindle (not shown). The pressurizing source may provide a pneumatic supply for increasing or decreasing the pressure within the chamber 202 of the polishing head assembly 200.

The floor 242 is a semi-rigid "flex plate" that is made of the same material as cap 240 (e.g., a metallic material). The floor 242 is adapted to be precisely deformed or deflected to change the pressure distribution and polishing pressure profile, and still be rigid enough to mount and demount the wafer on the backing film 110 by surface tension. The rigidity of the floor 242 is such that it does not substantially deform during the mounting of a wafer on the polishing head assembly 200. The floor 242 may be substantially flat in an initial or un-deflected state. The floor 242 temporarily deflects in a direction that is perpendicular to the polishing surface as the polishing pressure is increased and as the pressure within chamber 202 is increased. The cap 240 is not permanently deflected or deformed by the pressure. The floor 242 has the ability to transition to a pressurized deflected or downwardly curved shape (shown in FIG. 3), to a flat shape that is substantially parallel with a bottom surface of the polishing head 210 (shown in FIG. 2), and to an upwardly curved or convex shape (not shown), based on the amount of pressurized media or fluid supplied to the chamber 202 and the polishing pressure. The evenly distributed surface tension mounting and retaining the wafer on the backing film 110 provides direct deformation of the wafer when the pressure in the chamber 202 is adjusted and the floor 242 is deformed. Increasing or decreasing the pressure within the chamber 202 can thereby cause the surface of the floor 242 and wafer to balloon outwardly, remain flat, or be drawn in.

The change of pressure within chamber 202 causes a change to a given or predetermined polishing pressure P. The pressurizing source (not shown) may be connected with a controller (not shown) for monitoring and adjusting the pressure within the chamber 202. The controller may include a pressure regulator (not shown). The pressure can be adjusted either manually, based on general wafer shape of the incoming lot, or may be electronically controlled lot by lot, or even wafer by wafer. In some embodiments, a characteristic wafer profile is obtained from a lot of wafers, and the downward pressure applied to the wafer by the polishing head assembly 200 and the distribution of that pressure is varied by adjusting pressure in the chamber 202. Suitably, the change in polishing pressure may range from about 0.7 P to about 1.3 P. Thus, a change in polishing pressure P by changing the pressure within chamber 202 provides an operator with a control variable and the ability to adjust the polished shape of the wafer. In some embodiments, the predetermined polishing pressure may range from 1.0 psi to 4.0 psi. In other embodiments, the predetermined polishing pressure may be less than 6.0 psi.

Figure 3:
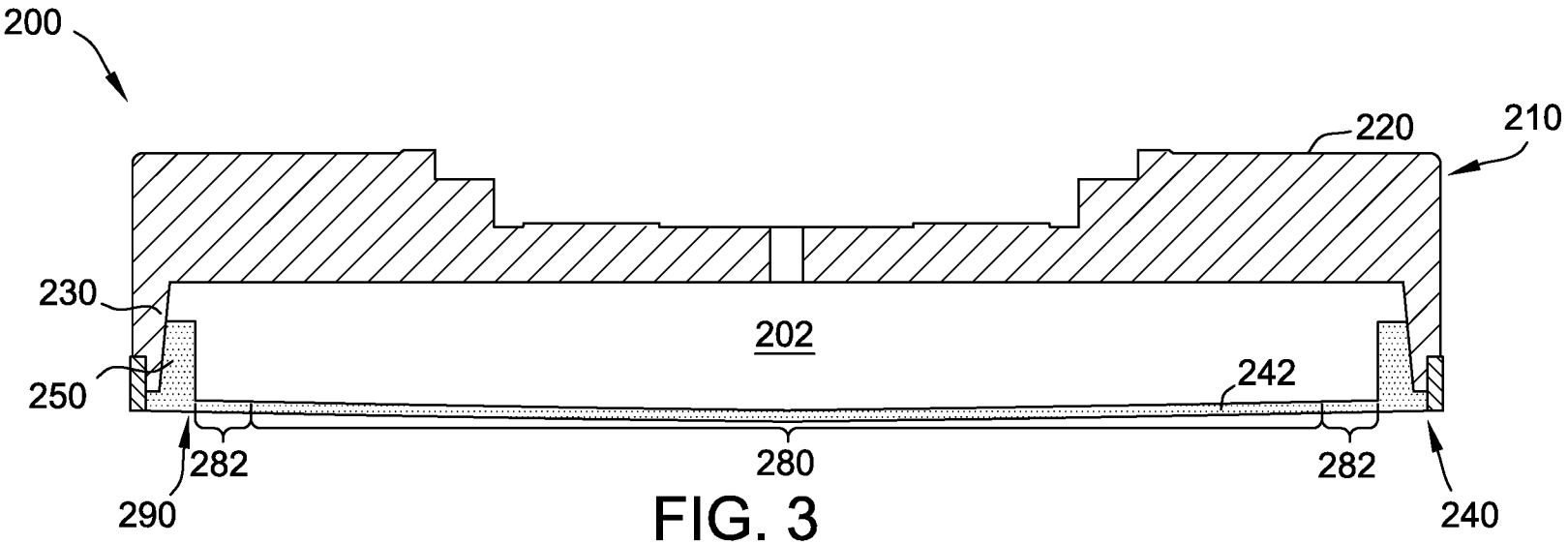
FIG. 3 is a section view of the polishing head assembly shown in FIG. 1 having a floor that only partially deflects downwardly.

Referring to FIG. 3, the polishing head assembly 200 of FIG. 2 is shown, with a portion 280 of floor 242 of cap 240 deflected into a downward dome shape as a result of an increase in pressure within chamber 202. Changing the shape of the floor 242 causes a resulting change in the force distribution of the polishing pressure across a wafer (e.g., wafer W shown in FIG. 1) and thereby causes the wafer to bend in response. The change in force distribution also causes a change in the rate of removal of material from the wafer. Generally, the rate of removal is increased when Von Mises stresses exerted between the wafer and the polishing pad 150 (shown in FIG. 1) are increased. The portion 280 of floor 242 that deflects in response to a change of pressure within chamber 202 increases or decreases these Von Mises stresses as the pressure within chamber 202 is increased or decreased, respectively.

It has been observed, however, that the removal of material from the wafer by polishing head assembly 200 is significantly reduced near the edge of the wafer. This is a result of a non-uniform stress distribution across floor 242, and in particular, lower Von Mises stresses being exerted between the edge of the wafer and the polishing pad 150. These Von Mises stresses are generally not capable of increasing even when the pressure within chamber 202 of polishing head assembly 200 is increased.

The reason for the non-uniform stress distribution is that floor 242 of polishing head assembly 200 does not completely and uniformly deflect in response to an increase and/or decrease of pressure within chamber 202. This is due to non-uniform deformation resistance across floor 242. As shown in FIG. 3, floor 242 is joined to annular wall 250 at joint 290. Joint 290 acts as a hinge about which the floor 242 may temporarily deflect without permanently deforming relative to the polishing head 210. Due to the semi-rigidity of floor 242, the portion 280 of floor 242 has a suitable deformation resistance to allow the portion 280 to deflect in response to a change of pressure within chamber 202. However, the deformation resistance increases at portion 282 of floor 242 proximate joint 290. As a result, portion 282 does not deflect in response to a change of pressure within chamber 202. Increasing the pressure within chamber 202 therefore does not cause a corresponding increase in Von Misses stresses exerted between the edge of the wafer which is mounted to portion 282 of floor 242 and the polishing pad 150. The non-uniform Von Mises stress distribution during polishing with polishing head assembly 200 produces a non-uniform removal profile in the polished wafer. Further, portion 282 defines a perimeter of floor 242 and may extend from joint 290 to portion 280 a radial distance of up to about 30 mm. Accordingly, the non-uniform removal profile may cover a substantial amount of the wafer, leading to an unacceptable flatness of the wafer.

It is believed that the thickness of annular wall 250 proximate joint 290 and/or the thickness of floor 242 proximate joint 290 may contribute to the relatively higher deformation resistance of the portion 282 of floor 242. A thickness of annular wall 250 proximate joint 290 is typically about 8 mm. The thickness of the annular wall 250 is measured as a distance between the outer surface 252 and an inner surface 253 of the annular wall 250. A thickness of the portion 282 of floor 242 is typically from about 5 mm to about 7 mm. The thickness of the floor 242 is measured as a distance between the top surface 244 and the bottom surface 246.

Figure 4:
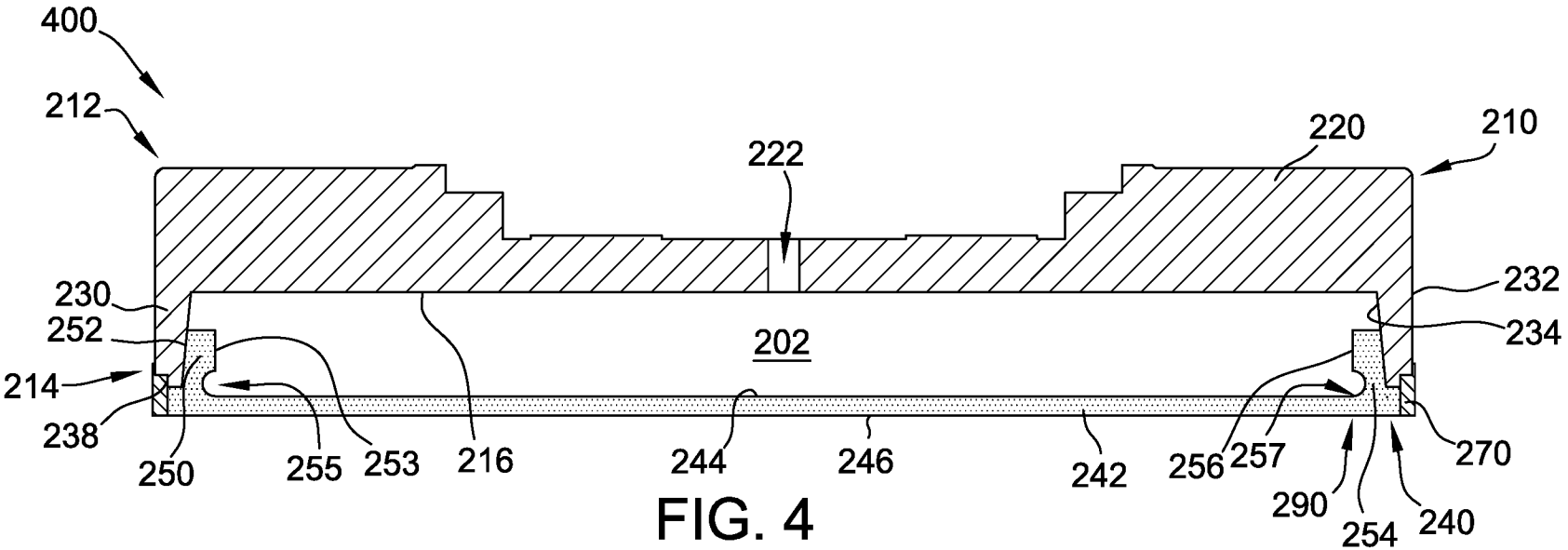
FIG. 4 is a section view of an example polishing head assembly adapted for mounting and use in the polishing apparatus shown in FIG. 1.

Referring now to FIG. 4, an example polishing head assembly 400 adapted for mounting and use in the polishing apparatus 100 is shown. Polishing head assembly 400 includes the elements and components of polishing head assembly 200 shown in FIG. 2 and described above. In addition, annular wall 250 of cap 240 includes a first portion 254 joined to floor 242 to form the joint 290 and a second portion 256 extending from the first portion 254. First portion 254 is defined by a notch 255 formed in an inner surface 253 of annular wall 250 at joint 290. Notch 255 may be U-shaped or may be substantially circular in shape. A radius of notch 255 is suitably above 1 mm, for example, from above 1 mm to about 3 mm, or about 2.5 mm. The first portion 254 of the annular wall 250 has a thickness that is less than a thickness of the second portion 256. The thickness of first portion 254 depends on the radius of notch 255.

Suitably, the radius of notch 255 is such that the thickness of first portion 254 is not reduced to below 1.5 mm. For example, the thickness of first portion 254 may suitably be from about 2 mm to about 5 mm, or about 3 mm. Notch 255 also forms a fillet 257 at joint 290. Reducing the thickness of first portion 254 and/or forming fillet 257 via notch 255 suitably weakens a deformation resistance of portion 282 of floor 242 proximate joint 290 (shown in FIG. 3).

The formation of notch 255 and/or fillet 257 to weaken the deformation resistance of portion 282 of floor 242 may suitably be performed using computer numeric control (CNC) milling. In general, notch 255 and/or fillet 257 cannot be formed using conventional machining techniques that are used to flatten the floor 242 of cap 240, such as a conventional lapping process. However, it is contemplated that modifications may be made to conventional machining techniques to form notch 255 and fillet 257. In addition, CNC milling may be used to provide portion 282 of floor 242 having a thickness of from about 5 mm to about 6 mm, such as 5.5 mm, for example. Floor 242 may suitably have a continuous thickness extending the entire diameter of floor 242 between annular wall 250. Alternatively, the thickness of the floor 242 may vary across the diameter of the floor 242 between the annular wall 250.

Figure 5:
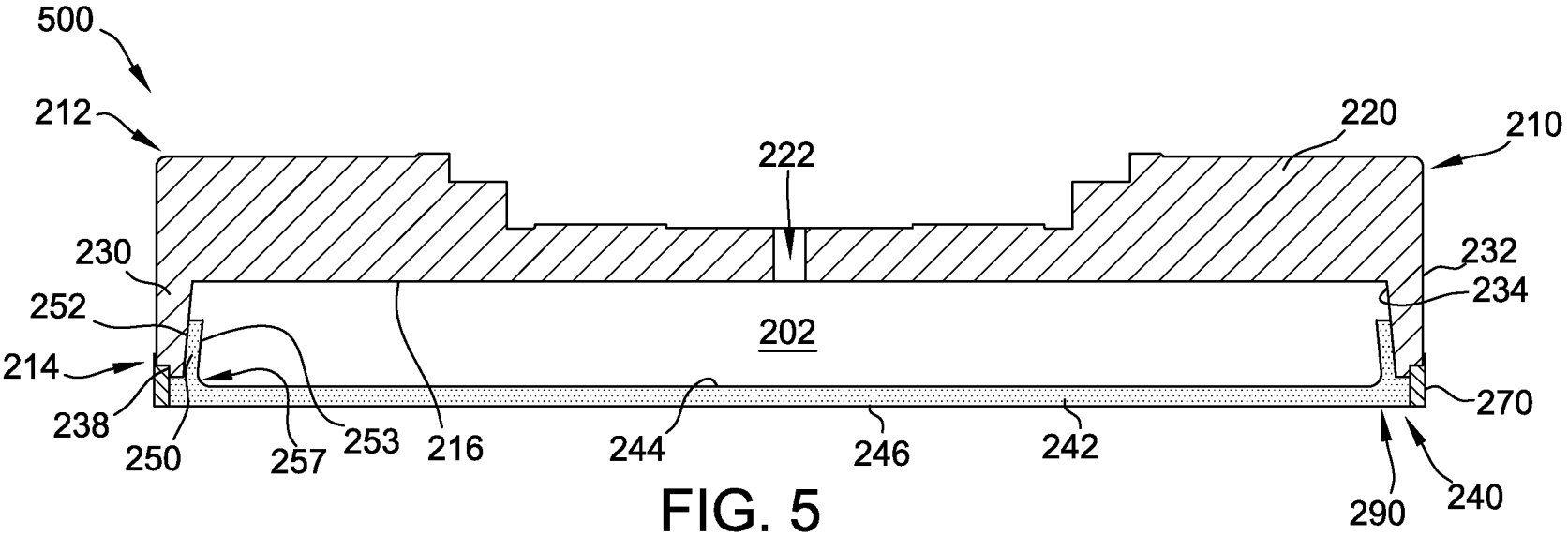
FIG. 5 is a section view of another example polishing head assembly adapted for mounting and use in the polishing apparatus shown in FIG. 1.

Referring to FIG. 5, another example polishing head assembly 500 adapted for mounting and use in the polishing apparatus 100 is shown. Polishing head assembly 500 includes the elements and components of polishing head assembly 200 shown in FIG. 2 and described above. In addition, the inner surface 253 of annular wall 250 is angled inwardly toward fillet 257 formed at joint 290. Suitably, the thickness of annular wall 250 at joint 290 is reduced to a thickness of from about 3 mm to about 5 mm, or about 3 mm. Inner surface 253 may be angled to match outer surface 252 such that the thickness of annular wall 250 is constant. Alternatively, inner surface 253 may be angled such that the thickness of annular wall 250 tapers inwardly down annular wall 250 toward joint 290, such that annular wall 250 has a smallest thickness at joint 290. Reducing the thickness of annular wall 250 at joint 290 and/or forming fillet 257 suitably weakens a deformation resistance of portion 282 of floor 242 proximate joint 290 (shown in FIG. 3).

The formation of the angled profile of inner surface 253 to reduce the thickness of annular wall 250, and the formation of fillet 257, to weaken the deformation resistance of portion 282 of floor 242 may suitably be performed using computer numeric control (CNC) milling. In general, fillet 257 and the angled profile of inner surface 253 cannot be formed using conventional machining techniques that are used to flatten the floor 242 of cap 240, such as a conventional lapping process. However, it is contemplated that modifications may be made to conventional machining techniques to form fillet 257 and the angled profile of inner surface 253. In addition, CNC milling may be used to provide portion 282 of floor 242 having a thickness of from about 5 mm to about 6 mm, such as 5.5 mm, for example. Floor 242 may suitably have a continuous thickness extending the entire diameter of floor 242 between annular wall 250. Alternatively, the thickness of the floor 242 may vary across the diameter of the floor 242 between the annular wall 250.

Figure 6:
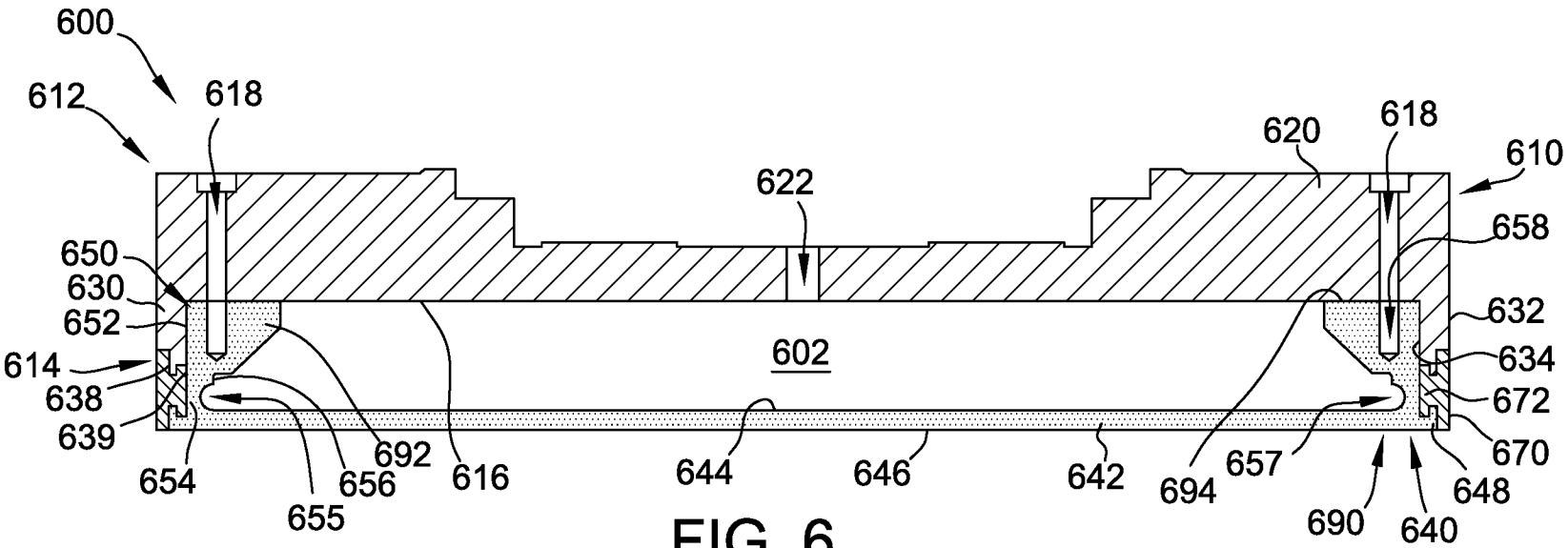
FIG. 6 is a section view of yet another example polishing head assembly adapted for mounting and use in the polishing apparatus shown in FIG. 1.

Referring now to FIG. 6, another example polishing head assembly 600 adapted for mounting and use in the polishing apparatus 100 is shown. The polishing head assembly 600 includes a polishing head 610, a cap 640, and a band 670. The polishing head 610 and/or cap 640 are suitably made of a metallic material, such as aluminum or steel, or may be made of another suitable structural material. For example, the polishing head 610 and/or cap 640 may be made of cast aluminum (for example, MIC6® Aluminum Cast Plate available from Alcoa.) Alternatively, the cap 640 may be made of a ceramic material, such as alumina, a plastic material, or a stainless steel material with anti-corrosion coating, such as, for example, diamond-like carbon.

The polishing head 610 has a top 612 and a bottom 614 that are substantially parallel with each other. The polishing head 610 has a platform 620 and an annular member 630 extending downwardly from the platform 620. A recessed surface 616 is formed in the bottom 614 of the polishing head 610 by the annular member 630 extending downwardly from the platform 620. Holes 618 extend from the top 612 through the platform 620 and through the recessed surface 616.

The annular member 630 has an outside surface 632 that is substantially perpendicular to the top 612 and bottom 614 of the polishing head 610. The outside surface 632 of the annular member 630 forms the circumference of both the polishing head 610 and the polishing head assembly 600. The annular member 630 has an inside surface 634 that is substantially parallel to the outside surface 632.

The cap 640 has a floor 642 and an upwardly extending annular wall 650 along the perimeter of the floor. The annular wall 650 has an outer surface 652 that mates with and is substantially parallel to the inside surface 634 of the annular member 630. The outer surface 652 of the annular wall 650 may attached to the inside surface 634 of the annular member 630 of the polishing head 610 with an adhesive (not shown). The adhesive may be an epoxy glue. The annular wall 650 extends upwardly to shoulder 692. The shoulder 692 has a top edge 694 that mates with the recessed surface 616 of polishing head 610. Apertures 658 are formed in shoulder 692 at top edge 694 and correspond to holes 618. The holes 618 and corresponding apertures 658 receive fasteners (not shown), such as, for example, screws, to attach the cap 640 to polishing head 610 by securing the top edge 694 of the shoulder 692 to the recessed surface 616. The fasteners may suitably be formed of plastic or a metallic material with an anti-corrosion coating. In addition or in the alternative, a lid (not shown) may cover at least a portion of top 612 of polishing head 610 to prevent the polishing chemicals or slurry from contacting the fasteners and/or from entering holes 618 during a polishing process. The shoulder 692 may also include o-ring (not shown) which forms a seal when the top edge 694 is secured to the recessed surface 616.

The floor 642 extends across a bottom opening formed by the annular member 630. The floor 642 has a top surface 644 and a bottom surface 646. A chamber 602 is formed between the top surface 644 of the floor 642 and the recessed surface 616 of the polishing head 610. The annular member 630 and the annular wall 650 determine the radial boundaries of the chamber 602. The platform 620 and the overlapping annular member 630 and annular wall 650 are thicker and are adapted to be more rigid than the floor 642.

Metal used in the polishing head assembly 600 has the potential to contaminate the wafer by being a source of metal ions through the polishing chemicals or slurry. To prevent the metal from cap 640 from contaminating the slurry and the wafer, a template including a backing film (e.g., backing film 110 shown in FIG. 1) and retaining ring (e.g., retaining ring 120 shown in FIG. 1) may be used to create a barrier between the slurry and the cap 640. The backing film 110 is generally a thin soft polymer pad or other suitable material. Backing film 110 suitably includes two or more layers of material (not shown). For example, backing film 110 may have an adhesive layer, a thin plastic film layer, and a thin polyurethane foam, or other non-woven material (e.g., felt), layer. The adhesive layer seals backing film 110 to bottom surface 646 of cap 640. The thin plastic film layer provides a protective barrier between cap 640 and the slurry and/or wafer W. The layer comprising polyurethane foam or non-woven material (e.g., felt) contacts the wafer and provides a surface similar to that a polishing pad (such as polishing pad 150 shown in FIG. 1). The retaining ring 120 extends downwardly from backing film 110 and is generally a plastic material. The wafer is received by retaining ring 120 and is retained against backing film 110 by surface tension. As such, the wafer does not directly contact the cap 640.

To prevent metal from the polishing head assembly 600 from contaminating the slurry and the wafer, the polishing head 610 and cap 640 are circumscribed with band 670 forming a barrier to prevent the slurry from contacting the metal and contaminating the wafer. The annular member 630 has a side recess 638 that extends inwardly from the outside surface 632 and an inner recess 639 that extends inwardly from the inside surface 634 at bottom 614. A tab 648 extends outwardly from the annular wall 650 of cap 640 opposite floor 642. Tab 648, side recess 638 and inner recess 639 each receive band 670 and may be sealed thereto with an adhesive, such as epoxy glue. The band 670 may overlap backing film 110 and/or retaining ring 120 of template to form a seal therebetween to prevent metal contamination of the polishing process from the polishing head 610. The band 670 is made of plastic, such as polyetherimide (for example, ULTEM™ Resin 1000 available from Saudi Basic Industries Corporation (SABIC)), polyether ether ketone, polyphenylene sulfide, or polyethylene terephthalate.

Band 670 may be non-unitary and is made of two or more segments. For example, band 670 may be made of three, four, five, or six segments. In these embodiments, band 670 may be sealed together at the segment joints (not shown) and sealed to polishing head 610 and/or cap 640 using an adhesive, such as epoxy glue. To prevent the seal between band 670 and polishing head 610 and/or cap 640 from coming loose due to adhesive failure, band 670 may include an interlocking member to secure band 670 to polishing head assembly 600. For example, band 670 may include a dovetail 672 which forms a joint with an inner recess 639 formed on the inside surface 634 of annular member 630 and with an upwardly extending member of tab 648. The dovetail 672 may be used to secure band 670 to polishing head 610 and/or cap 640 in addition to an adhesive or as an alternative.

Similar to polishing head assembly 200 described in detail herein, the chamber 602 is pressurized with a pressurized media or fluid. The chamber 602 may be connected with a pressurizing source (not shown) to provide the pressurized media or fluid to the chamber 602, as described herein for polishing head assembly 200. The pressurizing source (not shown) connects to a chamber passageway 622 (e.g., via a quick disconnect coupling plug). The chamber passageway 622 extends through the platform 620 to chamber 602. Similar to floor 242 described in detail herein, floor 642 is a semi-rigid "flex plate" that is adapted to be precisely deformed to change the pressure distribution and polishing pressure profile, and still be rigid enough to mount and demount the wafer on the backing film 110 by surface tension. Floor 642 is capable of temporarily deflecting relative to polishing head 610 without permanently deforming. Adjusting pressure in chamber 602 causes deflection of floor 642. In embodiments where shoulder 692 includes o-ring (not shown), a seal formed at the connection of the top edge 694 and recessed surface 616 may prevent leakage of the pressurized media or fluid from chamber 602, thereby maintaining a given pressure in chamber 602.

In addition to shoulder 692, annular wall 650 of cap 640 includes a first portion 654 joined to floor 642 to form a joint 690 about which the floor may temporarily deflect in response to a change in pressure within chamber 602. First portion 654 is connected to shoulder 692 with a second portion 656 extending between the first portion 654 and the shoulder 692. The thickness of the annular wall 650 is greatest at the shoulder 692, as shown in FIG. 6. First portion 654 is defined by a notch 655 formed in annular wall 650 at joint 690. Notch 655 may be U-shaped or may be substantially circular in shape. First portion 654 therefore has a thickness that is less than a thickness of the second portion 656. For example, the thickness of first portion 654 may be from about 3 mm to about 5 mm, or about 3 mm. Notch 655 also forms a fillet 657 at joint 690. Reducing the thickness of first portion 654 and/or forming fillet 657 via notch 655 suitably weakens a deformation resistance of a portion of floor 642 proximate joint 690 that is otherwise substantially incapable of deflecting in response to a change in pressure within chamber 602. This portion of floor may extend a radial distance of up to about 30 mm from joint 690 to a center of floor 642.

The formation of notch 655 and/or fillet 657 to weaken the deformation resistance of the portion of floor 642 proximate joint 690 may suitably be performed using computer numeric control (CNC) milling. In general, notch 655 and/or fillet 657 cannot be formed using conventional machining techniques that are used to flatten the floor 642 of cap 640, such as a conventional lapping process. However, it is contemplated that modifications may be made to conventional machining techniques to form notch 655 and fillet 657. In addition, CNC milling may be used to provide the portion of floor 642 proximate joint 690 having a thickness of from about 5 mm to about 6 mm, such as 5.5 mm, for example. Floor 642 may suitably have a continuous thickness extending the entire diameter of floor 642 between annular wall 650. Alternatively, the thickness of the floor 642 may vary across the diameter of the floor 642 between the annular wall 650. For example, the floor 642 may have a thickness that tapers inwardly from a center of floor 642 to joint 690 as described in further detail herein.

Figure 7:
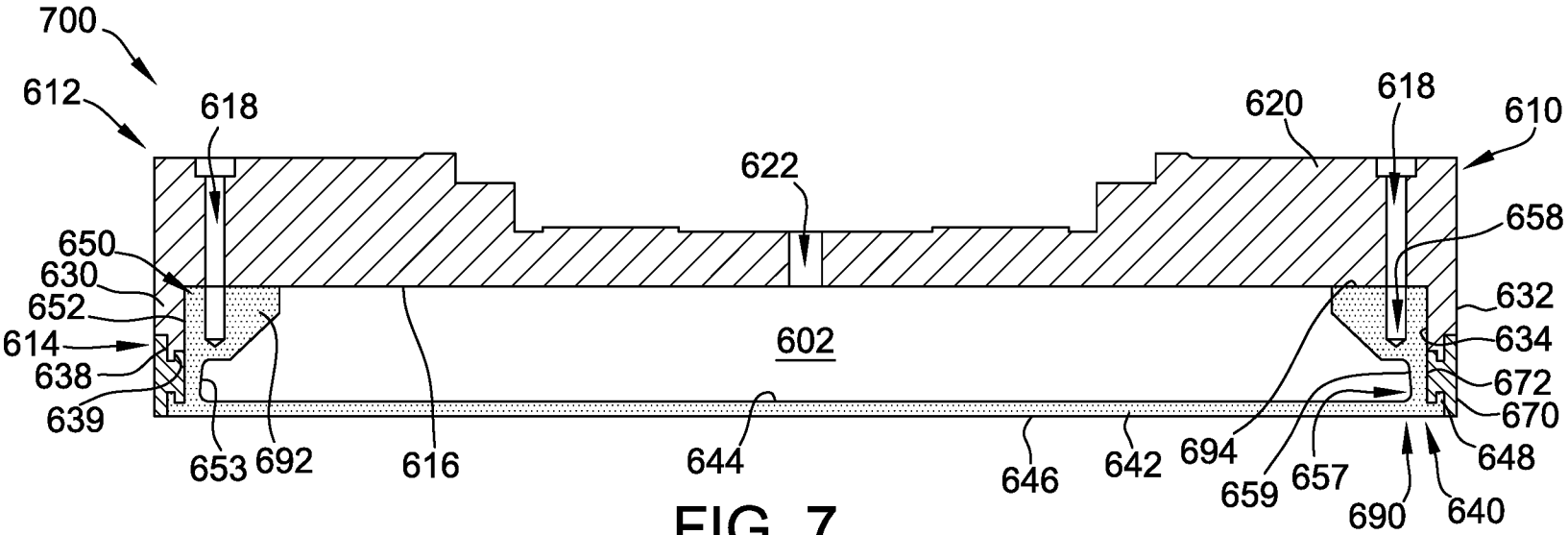
FIG. 7 is a section view of still another example polishing head assembly adapted for mounting and use in the polishing apparatus shown in FIG. 1.

Referring to FIG. 7, still another example polishing head assembly 700 adapted for mounting and use in the polishing apparatus 100 is shown. Polishing head assembly 700 includes the elements and components of polishing head assembly 600 shown in FIG. 6 and described above. In this example, a portion 659 of annular wall 650 that extends between shoulder 692 and fillet 657 has an inner surface 653 that is angled with respect to outer surface 652. The thickness of portion 659 of annular wall 650 tapers inwardly from shoulder 692 toward joint 690, such that annular wall 650 has a smallest thickness at joint 690. Suitably, the thickness of annular wall 650 at joint 690 is reduced to a thickness of from about 3 mm to about 5 mm, or about 3 mm. Reducing the thickness of annular wall 650 from shoulder 692 toward joint 690 and/or forming fillet 657 suitably weakens a deformation resistance of the portion of floor 642 proximate joint 690 that is otherwise substantially incapable of deflecting in response to a change in pressure within chamber 602. This portion of floor may extend a radial distance of up to about 30 mm from joint 690 toward a center of floor 642.

The formation of the angled profile of inner surface 653 to reduce the thickness of annular wall 650, and the formation of fillet 657, to weaken the deformation resistance of the portion of floor 642 proximate joint 690 may suitably be performed using computer numeric control (CNC) milling. In general, fillet 657 and the angled profile of inner surface 653 cannot be formed using conventional machining techniques that are used to flatten the floor 642 of cap 640, such as a conventional lapping process. However, it is contemplated that modifications may be made to conventional machining techniques to form fillet 657 and the angled profile of inner surface 653. In addition, CNC milling may be used to provide the portion of floor 642 proximate joint 690 having a thickness of from about 5 mm to about 6 mm, such as 5.5 mm, for example. Floor 642 may suitably have a continuous thickness extending the entire diameter of floor 642 between annular wall 650. Alternatively, the thickness of the floor 642 may vary across the diameter of the floor 642 between the annular wall 650. For example, the floor 642 may have a thickness that tapers inwardly from a center of floor 642 to joint 690 (shown in FIG. 8).

Figure 8:
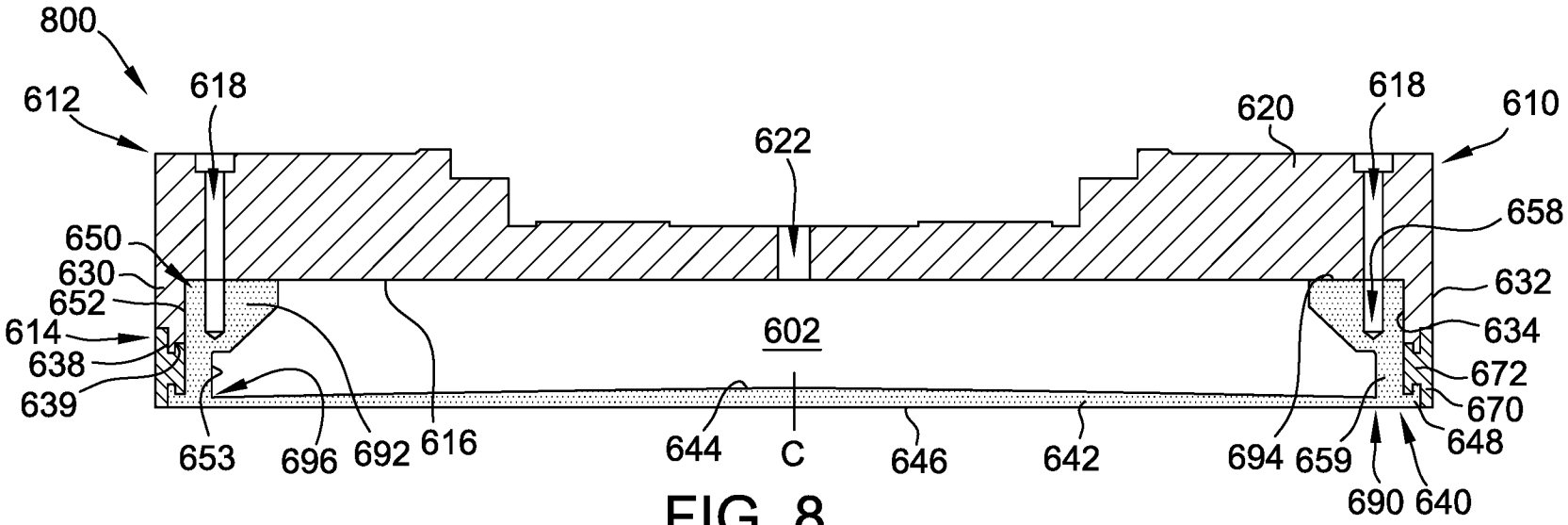
FIG. 8 is a section view of still yet another example polishing head assembly adapted for mounting and use in the polishing apparatus shown in FIG. 1; and Like reference symbols in the various drawings indicate like elements.

Referring to FIG. 8, another example polishing head assembly 800 adapted for mounting and use in the polishing apparatus 100 is shown. Polishing head assembly 800 includes similar elements and components of polishing head assembly 600 and/or 700 shown in FIGS. 6 and 7, respectively, and described above. To weaken the deformation resistance of the portion of floor 642 proximate joint 690, the thickness of floor 642 tapers inwardly from a radial center C of floor 642 toward joint 690. As such, the thickness of the floor 242 is greatest at the center C and is reduced to a minimum thickness at the joint 690. The thickness of floor 642 may taper from a thickness of from about 5 mm to 6 mm, or about 5.5 mm, at the center C to a thickness of from about 3 mm to about 4 mm, or about 3 mm, at joint 290. Tapering the thickness of floor 642 to reduce the thickness of floor 642 proximate joint 690 suitably weakens a deformation resistance of the portion of floor 642 proximate joint 690 that is otherwise substantially incapable of deflecting in response to a change in pressure within chamber 602. This portion of floor 642 proximate joint 690 may extend a radial distance of up to about 30 mm from joint 690 toward the radial center C of floor 642.

In the example polishing head assembly 800, annular wall 650 of polishing head assembly 800 may or may not include additional features to weaken the deformation resistance of the portion of floor 642 proximate joint 690 as described herein. For example, the portion 659 of annular wall 650 that extends between shoulder 692 and corner 696 may have an inner surface 653 that is substantially parallel to outer surface 652 such that the thickness of the portion 659 is substantially constant. Alternatively, the thickness of the portion 659 may be reduced at the joint 690. For example, the inner surface 653 may be angled with respect to outer surface 652 such that the thickness of portion 659 of annular wall 650 tapers inwardly from shoulder 692 toward joint 690 (as shown in FIG. 7). In addition, a corner 696 at joint 690 between inner surface 653 of annular wall 650 and top surface 644 of floor 642 may be angular, or may be filleted (i.e., to form fillet 657 shown in FIGS. 6 and 7). Suitably, the thickness of annular wall 650 at joint 690 may be about 8 mm, or may be reduced to a thickness of from about 3 mm to about 5 mm, or about 3 mm.

The formation of the tapered profile of floor 642 to weaken the deformation resistance of the portion of floor 642 proximate joint 690 may suitably be performed using computer numeric control (CNC) milling. In general, the tapered profile of floor 642 cannot be formed using conventional machining techniques that are used to flatten the floor 642 of cap 640, such as a conventional lapping process. However, it is contemplated that modifications may be made to conventional machining techniques to form the tapered profile of floor 642.

The embodiments described reduce deformation resistance of a floor of a cap of a polishing head assembly that is otherwise substantially incapable of deformation in response to a change of pressure with a chamber of the polishing head assembly. The embodiments enable a more uniform removal profile on a polished wafer. By weakening the portion of the floor that is otherwise substantially incapable of deformation in response to a change of pressure within the chamber, the distribution of Von Mises stresses exerted between the wafer and a polishing pad is more uniform during polishing. In particular, the Von Mises stresses exerted between the edge of the wafer and the polishing pad can be better controlled to fine-tune the removal profile near the edge of the wafer.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", "down", "up", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A polishing head assembly for polishing of semiconductor wafers, the polishing head assembly comprising:
- a polishing head having a recess along a bottom portion, the recess having a recessed surface; and
- a cap positioned within the recess, the cap comprising:
  - an annular wall secured to the polishing head, the annular wall comprising a first portion having a first thickness and a second portion extending from the first portion and having a second thickness; and
  - a floor joined to the annular wall at a joint, the floor extending across the annular wall, the floor having an upper surface and a lower surface, the upper surface spaced from the recessed surface to form a chamber therebetween, wherein the first portion of the annular wall is joined to the floor and the first thickness is less than the second thickness to weaken a deformation resistance of a portion of the floor proximate the joint compared to other portions of the floor to allow the portion of the floor proximate the joint to deflect relative to the polishing head by a change of pressure in the chamber.

2. The polishing head assembly of claim 1, wherein the first thickness is from about 3 mm to about 5 mm.

3. The polishing head assembly of claim 2, wherein the first thickness is about 3 mm.

4. The polishing head assembly of claim 1, wherein the floor has a continuous thickness of from about 5 mm to about 6 mm.

5. The polishing head assembly of claim 1, wherein:

the polishing head has a top portion and holes extending from the top portion through the recessed surface;

the annular wall further comprises a shoulder extending from the second portion, the shoulder having apertures corresponding to the holes; and the holes and the corresponding apertures receive fasteners to secure the shoulder of the annular wall to the recessed surface of the polishing head.

6. The polishing head assembly of claim 1, wherein the annular wall tapers inwardly toward the joint from the second thickness to the first thickness such that the first thickness of the annular wall is proximate the joint to weaken the deformation resistance of the portion of the floor proximate the joint.

7. The polishing head assembly of claim 6, wherein the first thickness of the annular wall proximate the joint is from about 3 mm to about 5 mm.

8. The polishing head assembly of claim 6, wherein the first thickness of the annular wall proximate the joint is about 3 mm.

9. The polishing head assembly of claim 6, wherein the floor has a continuous thickness of from about 5 mm to about 6 mm.

10. The polishing head assembly of claim 1, wherein a thickness of the floor tapers inwardly toward the joint such that the thickness of the floor is smallest at the portion proximate the joint to weaken the deformation resistance of the portion of the floor proximate the joint.

11. The polishing head assembly of claim 10, wherein the thickness of the floor is greatest at a center of the floor.

12. The polishing head assembly of claim 11, wherein the thickness of the floor at the portion proximate the joint is about 3 mm and the thickness of the floor at the center is from about 5 mm to about 6 mm.

13. The polishing head assembly of claim 1, wherein the cap is made of a metallic material.

14. The polishing head assembly of claim 1, wherein the annular wall is secured to the polishing head with an adhesive.

15. A polishing head assembly for polishing of semiconductor wafers, the polishing head assembly comprising:

a polishing head having a top portion and a recess along a bottom portion, the recess having a recessed surface, and holes extending from the top portion through the recessed surface;

a cap positioned within the recess, the cap comprising:

an annular wall having apertures corresponding to the holes, wherein the holes and corresponding apertures receive fasteners to secure the annular wall to the recessed surface; and a floor joined to the annular wall at a joint, the floor extending across the annular wall, the floor having an upper surface and a lower surface, the upper surface spaced from the recessed surface to form a chamber therebetween, the floor capable of deflecting relative to the polishing head by a change of pressure in the chamber;

wherein a deformation resistance of a portion of the floor proximate the joint is weakened relative to other portions of the floor to allow the portion of the floor proximate the joint to deflect relative to the polishing head.

16. The polishing head assembly of claim 15, wherein a thickness of the floor tapers inwardly toward the joint such that the thickness of the floor is smallest at the portion proximate the joint to weaken the deformation resistance of the portion of the floor proximate the joint.

17. The polishing head assembly of claim 16, wherein the thickness of the floor at the portion proximate the joint is about 3 mm and the thickness of the floor at a center of the floor is from about 5 mm to about 6 mm.

18. The polishing head assembly of claim 15, wherein the cap is made of a metallic material.

19. A polishing head assembly for polishing of semiconductor wafers, the polishing head assembly comprising:

a polishing head having a platform and holes extending through the platform; and a cap having an annular wall secured to the polishing head and a floor joined to the annular wall at a joint, the annular wall having apertures corresponding to the holes, wherein the holes and corresponding apertures receive fasteners to secure the annular wall to the platform of the polishing head;

wherein the polishing head and the cap define a chamber between the polishing head and the floor of the cap;

wherein the floor is made from a metallic material capable of deflecting relative to the polishing head in response to a change in pressure in the chamber; and wherein a thickness of at least one of the annular wall and the floor is reduced proximate the joint to weaken a deformation resistance of the floor proximate the joint compared to other portions of the floor.

* * * * *